United States Patent [19]

Guido et al.

[11] 4,060,990

[45] Dec. 6, 1977

[54] POWER GENERATION SYSTEM

[75] Inventors: Paul Vincent Guido, Cedar Grove; Robert Lenox Criswell, Florham Park; Albert John Zipay, Clifton, all of N.J.

[73] Assignee: Foster Wheeler Energy Corporation, Livingston, N.J.

[21] Appl. No.: 659,300

[22] Filed: Feb. 19, 1976

[51] Int. Cl.[2] ..... F01K 13/00

[52] U.S. Cl. ..... 60/676; 60/679

[58] Field of Search ..... 60/660–667, 60/679, 680, 677, 678, 676, 646

[56] References Cited

U.S. PATENT DOCUMENTS

| | | | |
|---|---|---|---|
| 2,676,574 | 4/1954 | Wenzel | 60/676 X |
| 3,140,588 | 7/1964 | Brown | 60/680 X |
| 3,163,991 | 1/1965 | Capitaine | 60/679 X |
| 3,358,450 | 12/1967 | Schroedter | 60/646 |
| 3,359,732 | 12/1967 | Schuetzenduebel | 60/646 |
| 3,488,961 | 1/1970 | Gerber | 60/662 X |
| 3,882,680 | 5/1975 | Durrant | 60/646 |

FOREIGN PATENT DOCUMENTS

| | | | |
|---|---|---|---|
| 1,253,461 | 1/1961 | France | 60/679 |

*Primary Examiner*—Allen M. Ostrager
*Attorney, Agent, or Firm*—Marvin A. Naigur; John E. Wilson

[57] ABSTRACT

A power generation system in which one or more vapor generators are provided for driving a turbine having a relatively high pressure section and at least one relatively low pressure section. A reheater is disposed between the high pressure turbine section and the low pressure turbine section and its outlet is connected to the latter section. The steam outlet of the vapor generator is connected directly to the high pressure turbine section and directly to the reheater, and the outlet of the reheater is connected directly to the low pressure turbine section and directly to the condenser.

13 Claims, 1 Drawing Figure

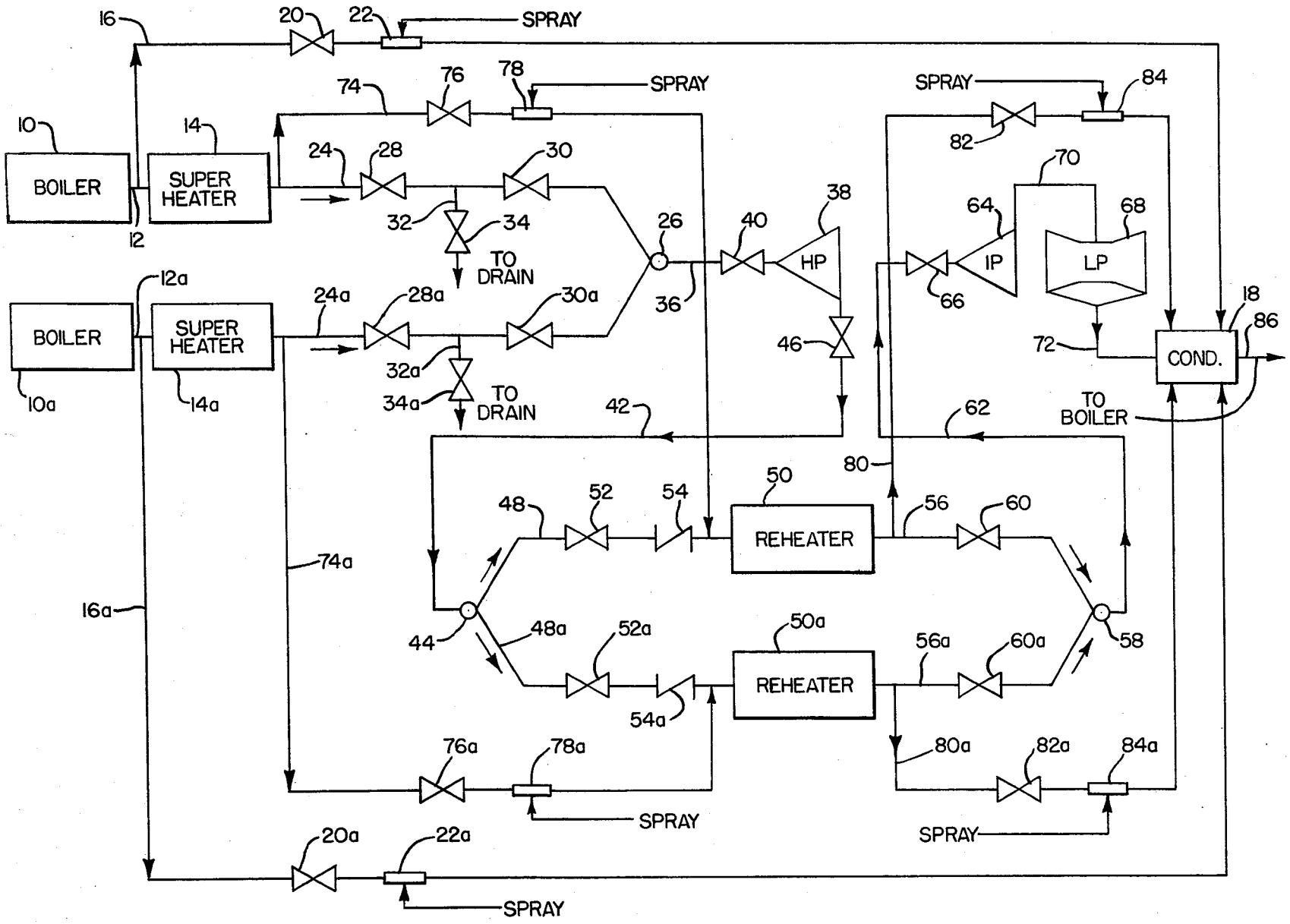
COND.
LP
IP
HP
REHEATER
REHEATER
SUPER HEATER
SUPER HEATER
BOILER
BOILER
TO BOILER
TO DRAIN
TO DRAIN
SPRAY
SPRAY
SPRAY
SPRAY
SPRAY
SPRAY

POWER GENERATION SYSTEM

BACKGROUND OF THE INVENTION

This invention relates to a power generation system and, more particularly, to such a system in which the condition of the vapor output from one or more vapor generators is precisely controlled before being passed to a turbine for driving same.

In the design of power generation systems, it is often necessary to carefully control the critical parameters, such as temperature and pressure, of steam from a vapor generator before it is passed to a turbine. For example, power generation systems may utilize two vapor generators which operate to drive a single turbine. In this manner, the vapor generators can be designed to operate at approximately half the load of the turbine so that, upon failure of one of the generators, the turbine still will be driven by the other generator to avoid a complete stoppage of the turbine. However, in systems of this type, when one of the vapor generators is started up after being shut down for any reason, the temperature and pressure conditions of the vapor generated by the starting up vapor generator must be carefully regulated so that it will match the temperature and pressure conditions of the vapor generated by the other vapor generator that is in operation since, otherwise, the turbine may be severely damaged.

SUMMARY OF THE INVENTION

It is, therefore, an object of the present invention to provide a power generation system of the above type which enables the temperature and pressure conditions of steam generated by a vapor generator to be carefully controlled.

It is a further object of the present invention to provide a power generating system of the above type in which two vapor generators are provided for driving a turbine and in which the temperature and pressure conditions of the steam generated by each generator is precisely controlled to effect optimum matching of the two supplies of steam before they are passed to the turbine.

It is a still further object of the present invention to provide a power generation system of the above type in which the steam output from either of the vapor generators is selectively directed to various other stages of the system in order to selectively control its pressure and temperature conditions.

Toward the fulfillment of these and other objects, the power generation system of the present invention comprises at least one vapor generating means, a relatively high pressure turbine section and at least one relatively low pressure turbine section, a reheater, a condenser, fluid transfer means connecting said vapor generating means directly to said high pressure turbine section and directly to said reheater, and fluid transfer means connecting said reheater directly to said low pressure turbine section and directly to said condenser.

BRIEF DESCRIPTION OF THE DRAWINGS

The drawing is a schematic representation of the fluid circuit of the power generation system of the present invention.

DESCRIPTION OF THE PREFERRED EMBODIMENTS

Referring specifically to the drawing, the reference numeral 10 refers in general to a boiler which is connected via a line 12 to a superheater 14. For the purposes of this application, it is to be understood that the term "line" is meant to cover all possible fluid transfer systems, such as tubes, conduits, downcomers, and the like, which are normally associated with this type of equipment. As an example, the line 12 could be in the form of tubes connecting one section of a finned tube wall forming the furnace section of the boiler, with another section thereof.

A line 16 extends from the line 12 and is connected to a condenser 18 for supplying fluid from the boiler 10 directly to the condenser without passing through the superheater 14. A flow control valve 20 and a desuperheating unit 22 are provided in the line 16 for reasons that will be indicated in detail later. The outlet of the superheater 14 is connected, via a line 24, to a (Y) junction header 26 with stop-check valve 28 and stop valve 30 being imposed in line 24. Also, a line 32 extends from the line 24 at a point between the stop-check valve 28 and stop valve 30 for connecting the line 24 to drain, with a flow control valve 34 being disposed in the line 32 for the purpose of checking the tightness of valves 28 and 30.

The outlet of the (Y) junction header 26 is connected, via a line 36, to the high pressure section 38 of a turbine, and a flow control valve 40 is disposed in the line 36 for controlling the flow of fluid to the latter section. A line 42 connects the outlet of the high pressure turbine section 38 to a (Y) junction header 44 and a stop-check valve 46 is disposed in the line 42. The outlet of the (Y) junction header 44 is connected, via a line 48, to a reheater 50. A flow control valve 52 and a check valve 54 are disposed in the line 48.

A line 56 connects the outlet of the reheater 50 to a (y) junction header 58 with a stop-check valve 60 being disposed in the line 56. The outlet of the (Y) junction header 58 is connected, via a line 62, to the intermediate pressure section 64 of the above-mentioned turbine and a flow control valve 66 being disposed in the line 62. The intermediate pressure section 64 of the turbine is connected to a low pressure section 68 by a line 70, with the output of the low pressure section being connected to the condenser 18 by a line 72.

A bypass line 74 connects with the line 24 at a point between the superheater 14 and the valve 28, and with the line 48 at a point between the check valve 54 and the reheater 50. A pressure reducing valve 76 and a desuperheating unit 78 are disposed in the line 74.

A bypass line 80 connects with the line 56 at a point between the reheater 50 and the valve 60, and connects the latter line directly to the condenser 18, with a pressure regulating valve 82 and a desuperheating unit 84 being disposed in the line 80.

It should be noted that the basic fluid flow circuit would extend through the appropriate lines just mentioned from the boiler 10 through the superheater 14 and the (Y) junction header 26, and to the high pressure turbine section 38. From the latter turbine section the fluid would flow through the (Y) junction header 44, the reheater 50 and into the (Y) junction header 58, from which it passes to the intermediate pressure turbine section 64. From the latter turbine section, the fluid would then pass into the low pressure turbine section 68 and to the condenser 18. It is understood that a line 86 extends from the outlet of the condenser and is connected to the boiler 10 in a conventional manner with feedwater heaters and other associated conventional equipment provided in the line 86.

The boiler 10, the superheater 14 and their corresponding lines, bypass lines and associated equipment are duplicated in any parallel circuit. Also, the circuit extending between the (Y) junction headers 44 and 58 and including the reheater 50 and the associated bypass lines, is duplicated in any parallel circuit. Since the components of the respective parallel circuits operate in an identical manner, they are given the same reference numeral as their respective corresponding components and with the suffix "a" and will not be discussed in any further detail.

It is apparent from the foregoing that variations in the flow circuit from the above-mentioned standard circuit can be made by operation of the various flow control valves. For example, the valves 20 or 20*a*can be opened to pass a portion of the fluid from the boiler 10 or 10*a* to the condenser 18 and thus bypass the superheaters 14 and 14*a*. Also, the pressure reducing valves 76 or 76*a* may be opened to pass a portion of the fluid from the outlet of the superheaters 14 and 14*a*, respectively, directly to the reheaters 50 and 50*a*, respectively and thus bypass the high pressure section 38 of the turbine. Further, the valves 82 and 82*a* may be opened to permit a portion of the fluid to pass from the outlet of the reheaters 50 and 50*a* respectively directly to the condenser 18, and thus bypass the intermediate pressure section 64 and the low pressure section 68 of the turbine.

According to a preferred embodiment of the present invention, the various control valves may be operated in response to temperature and pressure conditions of the fluid at various stages of the circuit. For example, the control valves 20 and 20*a* may be operated in response to the temperature of the fluid at the outlet of the superheater 14 and the pressure reducing valves 76 and 76*a* may be controlled by fluid pressure as measured at the outlet of the superheater 14 and 14*a*, respectively, in a manner to control the steam flowing through the line 74 and 74*a*.

Similarly, the valves 52 and 52*a* may be operated in response to flow from the superheaters 14 and 14*a*, respectively, to control the flow through the lines 48 and 48*a*, respectively, thereby proportioning the steam applied to the reheaters 50 and 50*a*, respectively, from that coming from the high pressure section 38 of the turbine and from the superheaters 14 and 14*a*, respectively. This also could apply to the valves 60, 60*a*, 82, and 82*a* to proportion the hot reheat steam flow between the intermediate pressure section 64 of the turbine and direct discharge to the condenser 18. The aforementioned control connections are not shown in the drawings and will not be described in any further detail for the convenience of presentation, since they may be of a conventional design.

It can be appreciated that the provision of the several bypass lines 16, 16*a*, 74, 74*a*, 80 and 80*a*, as well as the parallel flow circuit including the additional boiler 10*a*, superheater 14*a*, enable the fluid flow to be selectively passed to and through the system to precisely control the pressure and temperature conditions of the fluid.

In normal operation, both vapor generators including the boilers 10 and 10*a*, their respective superheaters 14 and 14*a*, and the associated components are placed in full operation to drive the turbine. In this type of system, the turbine could be designed for a load approximately twice that of each individual vapor generator so that both boilers contribute equally in driving the turbine. In this normal operation, the fluid flow would be in the main circuit described immediately above with the control valves 20, 20*a*, the pressure reducing valves 76 and 76*a*, the pressure regulating valves 82, and 82*a* being closed to prevent fluid flow through the bypass lines 16, 16*a*, 74, 74*a*, 80, and 80*a*, respectively.

In the event one of the vapor generators is shut down due to its failure, or for other purposes such as cleaning, etc., the remaining vapor generator would be used to drive the turbine at approximately half load. The features of the present invention are especially important when the inoperative vapor generator is started up and the following operational description will be predicated on a start-up of the boiler 10 and its associated superheater 14 while the boiler 10*a* and the superheater 14*a* are in full operation.

In particular, upon initial firing of the boiler 10, the control valve 20 is opened to permit a portion of the vapor generated in the boiler 10 to bypass the superheater 14 and pass directly to the condenser 18. This will enable a relatively larger amount of heat to be transferred to the remaining vapor passing to the superheater 14 and thus bring the temperature of this fluid up to a relatively high value when it passes thru the superheater 14. The control valve 76 may also be opened to permit a portion of the vapor from the superheater to be passed directly to the reheater 50 and thus bypass the high pressure turbine section 38. Since the remaining vapor flowing in the line 24 is still receiving heat from the furnace section of the boiler, its temperature is raised to the extent it matches the temperature of the vapor from the superheater 14*a*. As a result, the vapors mixing in the junction header 26 are suitable for passage directly into the high pressure turbine section 38. As the vapor flow to the latter section increases, the flow through the bypass line 74 is reduced accordingly by virtue of the control of the valve 76 in response to flow from the superheater 14, as discussed above.

The valve 20 and the desuperheating unit 22 reduce the pressure and temperature, respectively, of the fluid passing through the line 16 to the condenser. Also, the pressure reducing valve 76 and the desuperheater unit 78 reduce the pressure and temperature, respectively, of the vapor flowing in the line 74 before it mixes with the fluid in the line 48 from the high pressure turbine section 38, before passing into the reheater 50.

The check valves 54 and 54*a* function to prevent any back flow of vapor in the lines 48 and 48*a*, respectively, towards the (Y) junction header 44 and possibly towards the high pressure turbine section 38.

The stop check valve 60 and the pressure regulating valve 82 may be selectively controlled to permit the flow from the reheater 50 to be proportioned between flow directly to the condenser 18 and flow to the intermediate pressure turbine section 64, as discussed above. This insures that the vapor entering the intermediate turbine section 64 is at the proper condition. The desuperheating units 84 and 84*a* reduce the temperature of the vapor in the lines 80 and 80*a*, respectively, before it enters the condenser 18.

As a result, the condition of the fluid from the boiler 10 and the superheater 14, as they are started up, can be carefully matched to that from the operable vapor generator, including the boiler 10*a* and the superheater 14*a*, to insure that no damage will be made to the various lines and turbine sections.

Although not expressly shown in the drawings, it is understood that the various control valves, such as 20, 20*a*, 76, 76*a*, 82, and 82*a* may, in actual practice, comprise both a flow control valve which is operated as described above and, in addition, a valve which provides a further insurance that during its closing no leakage occurs through the corresponding lines. It is also understood that the various desuperheating units 22, 22*a*, 78, 78*a*, 84, and 84*a*may also have valves of the above type associated with them.

It is understood that several variations may be made in the foregoing without departing from the scope of the invention. For example, the present invention is not limited to the application of a power generation system employing dual vapor generators, but can be easily applied to other designs of power generation systems in which the temperature and pressure conditions of the fluid flowing in one or more circuits must be precisely controlled.

Of course, still other variations of the specific construction and arrangement of the power generation system disclosed above can be made by those skilled in the art without departing from the invention as defined in the appended claims.

What is claimed is:

1. A power generating system comprising vapor generating means, a turbine having a relatively high pressure section and at least one relatively low pressure section, first fluid transfer means connecting said vapor generating means to said high pressure turbine section, a condenser, second fluid transfer means connecting said turbine to said condenser, third fluid transfer means for connecting said vapor generating means directly to said condenser, at least two reheaters connected in parallel, and fourth fluid transfer means connecting each reheater between said high pressure turbine section and said low pressure turbine section.

2. The system of claim 1 wherein said vapor generating means has an inlet for receiving liquid and an outlet for discharging vapor, said third fluid transfer means connecting said outlet directly to said condenser.

3. The system of claim 1 wherein said vapor generating means comprises at least two boilers, said first fluid transfer means connecting said boilers to said high pressure turbine section and said third fluid transfer means connecting said boilers to said condenser.

4. The system of claim 3 wherein said vapor generating means further comprises at least two superheaters, said first fluid transfer means respectively connecting said boilers to said superheaters, and said superheaters to said high pressure turbine section.

5. The system of claim 4 further comprising fluid transfer means connecting said superheaters directly to said reheaters.

6. The system of claim 1 further comprising fluid transfer means connecting said reheaters directly to said condenser.

7. The system of claim 4 further comprising fluid transfer means respectively connecting said superheaters directly to said reheaters and said reheaters directly to said condenser.

8. A power generating system comprising vapor generating means including at least two boilers and at least two superheaters, a turbine, first fluid transfer means connecting said boilers to said superheaters and said superheaters to said turbine, a condenser, second fluid transfer means connecting said turbine to said condenser, third fluid transfer means for connecting said boilers directly to said condenser, at least two reheaters, and fourth fluid transfer means respectively connecting said superheaters directly to said reheaters and said reheaters directly to said condenser.

9. The system of claim 8 wherein said turbine comprises a relatively high pressure section and at least one relatively low pressure section, said first fluid transfer means connecting said boilers to said high pressure section.

10. The system of claim 9 further comprising fluid transfer means connecting said reheaters between said high pressure section and said low pressure section of said turbine.

11. The system of claim 8 wherein each of said boilers has an inlet for receiving liquid and an outlet for discharging vapor, said third fluid transfer means connecting said outlets directly to said condenser.

12. A power generation system comprising two vapor generating means, a relatively high pressure turbine section and at least one relatively low pressure turbine section, two reheaters, a condenser, fluid transfer means connecting said vapor generating means in parallel directly to said high pressure turbine section, fluid transfer means respectively connecting said vapor generating means directly to said reheaters, and fluid transfer means connecting said reheaters directly to said low pressure turbine section and directly to said condenser.

13. The system of claim 12 wherein each of said vapor generating means comprises at least one boiler and at least one superheater, and further comprising fluid transfer means respectively connecting said boilers directly to said superheaters, and fluid transfer means connecting said boilers directly to said condenser.

* * * * *